US011542452B2

(12) United States Patent
Gutierrez et al.

(10) Patent No.: US 11,542,452 B2
(45) Date of Patent: Jan. 3, 2023

(54) SILVER CORROSION INHIBITOR COMPOSITION AND METHOD OF USE

(71) Applicant: BL Technologies, Inc, Minnetonka, MN (US)

(72) Inventors: Roberto Gutierrez, The Woodlands, TX (US); Hitesh Ghanshyam Bagaria, The Woodlands, TX (US); Moshood Adewale, The Woodlands, TX (US); Ronald Gropp, The Woodlands, TX (US)

(73) Assignee: BL Technologies, Inc., Minnetonka, MN (US)

( * ) Notice: Subject to any disclaimer, the term of this patent is extended or adjusted under 35 U.S.C. 154(b) by 0 days.

(21) Appl. No.: 17/264,729

(22) PCT Filed: Aug. 9, 2018

(86) PCT No.: PCT/US2018/046068
§ 371 (c)(1),
(2) Date: Jan. 29, 2021

(87) PCT Pub. No.: WO2020/032954
PCT Pub. Date: Feb. 13, 2020

(65) Prior Publication Data

US 2021/0301214 A1 Sep. 30, 2021
US 2022/0177797 A9 Jun. 9, 2022

(51) Int. Cl.
*C10L 10/04* (2006.01)
*C10L 1/188* (2006.01)
*C10L 1/24* (2006.01)

(52) U.S. Cl.
CPC ..... *C10L 10/04* (2013.01); *C10L 1/1883* (2013.01); *C10L 1/2456* (2013.01); *C10L 2270/023* (2013.01)

(58) Field of Classification Search
CPC ..... C10L 10/04; C10L 1/1881; C10L 1/1883; C10L 1/2456; C10L 2270/023
See application file for complete search history.

(56) References Cited

U.S. PATENT DOCUMENTS 2,850,453 A 9/1958 Fields
3,663,561 A 5/1972 Blaha
(Continued)

FOREIGN PATENT DOCUMENTS

CA 2174171 C 6/2003
CN 106350172 A 1/2017
(Continued)

OTHER PUBLICATIONS

Database WPI, Week 201726, Thomson Scientific, London, GB, AN 2017-10642E, XP002790043.
(Continued)

*Primary Examiner* — Ellen M McAvoy
*Assistant Examiner* — Chantel L Graham
(74) *Attorney, Agent, or Firm* — Armstrong Teasdale LLP

(57) ABSTRACT

A synergistic fuel additive composition, the composition having a sulfur additive; and a non-sulfur containing additive, wherein the ratio of the sulfur additive to the non-sulfur additive is about 1:1 to about 1:100. A method of reducing sulfur content in a fuel composition, the method provides adding a fuel additive to a fuel composition, the fuel composition having a silver corrosion inhibitor, the fuel additive having: a sulfur additive and a non-sulfur containing additive, wherein the ratio of the sulfur additive to the non-sulfur containing additive is from about 1:1 to about 1:100; wherein the fuel additive provides less than 5 ppm of sulfur addition to the fuel composition; and wherein the fuel composition does not cause silver corrosion.

14 Claims, 1 Drawing Sheet

Silver Strip Test Results (ASTM D7671) with Hydrocarbon Containing 10ppmw $H_2S$ Liquid

| Test Date | Experiment # | Oil | Product | Dosage (ppmv) | Naphtha vol. (mL) | product vol. (μL) | Silver Strip Rating | Time | Test Temp. (°C) | H2S Liquid Phase | PPM Sulfur Added |
|---|---|---|---|---|---|---|---|---|---|---|---|
| 4/5/2018 | 1 | Naptha | Blank | 0 | 30 | 0 | 3 | 180mins | 50 | 10 | 0.00 |
| 3/20/2018 | 2 | Naptha | DDSA | 20 | 30 | 6 | 2 | 180mins | 50 | 10 | 0.00 |
| 3/22/2018 | 3 | Naptha | Alkyl Dithiothiadiazole | 10 | 30 | 3 | 2 | 180mins | 50 | 10 | 2.50 |
| 3/22/2018 | 4 | Naptha | Alkyl Dithiothiadiazole | 20 | 30 | 6 | 1 | 180mins | 50 | 10 | 5.00 |
| 4/6/2018 | 5 | Naptha | 80% DDSA 20% Alkyl Dithiothiadiazole | 10 | 30 | 2.4 .6 | 1 | 180mins | 50 | 10 | 0.50 |
| 4/5/2018 | 6 | Naptha | 80% DDSA 20% Alkyl Dithiothiadiazole | 20 | 30 | 4.8 1.2 | 1 | 180mins | 50 | 10 | 1.00 |
| 4/5/2018 | 7 | Naptha | 80% DDSA 20% Alkyl Dithiothiadiazole | 40 | 30 | 9.6 2.4 | 1 | 180mins | 50 | 10 | 2.00 |
| 4/5/2018 | 8 | Naptha | 80% DDSA 20% Alkyl Dithiothiadiazole | 80 | 30 | 19.2 4.8 | 1 | 180mins | 50 | 10 | 4.00 |

(56) References Cited

U.S. PATENT DOCUMENTS

| | | | | |
|---|---|---|---|---|
| 4,128,403 | A | 12/1978 | Honnen | |
| 5,080,686 | A | 1/1992 | Garrecht et al. | |
| 5,177,213 | A | 1/1993 | Karol | |
| 5,275,630 | A | 1/1994 | Dorer | |
| 5,302,304 | A | 4/1994 | Valcho | |
| 5,653,787 | A | 8/1997 | Poirier | |
| 5,653,878 | A | 8/1997 | Reid | |
| 9,574,149 | B2 | 2/2017 | Fang et al. | |
| 2005/0032654 | A1 | 2/2005 | Mondal et al. | |
| 2008/0086935 | A1* | 4/2008 | Cunningham | C10L 10/00 44/418 |
| 2008/0202561 | A1 | 8/2008 | Dumont et al. | |
| 2008/0216393 | A1 | 9/2008 | Dumont et al. | |
| 2013/0227878 | A1* | 9/2013 | Wolf | C10L 1/2387 44/434 |

FOREIGN PATENT DOCUMENTS

| | | | |
|---|---|---|---|
| EP | 1914292 | A1 | 4/2008 |
| GB | 1377433 | A | 12/1974 |

OTHER PUBLICATIONS

International Search Report for corresponding application No. PCT/US2018/046068 dated Apr. 15, 2019, 5 pages.

Office Action and Search Report issued in Chinese Patent Application No. 201880096461.X, dated May 25, 2022, with English translation of Search Report, 13 pages.

* cited by examiner

| Silver Strip Test Results (ASTM D7671) with Hydrocarbon Containing 10ppmw $H_2S$ Liquid | | | | | | | | | | | |
|---|---|---|---|---|---|---|---|---|---|---|---|
| **Test Date** | **Experiment #** | **Oil** | **Product** | **Dosage (ppmv)** | **Naphtha vol. (mL)** | **product vol. (µL)** | **Silver Strip Rating** | **Time** | **Test Temp. (°C)** | **H2S Liquid Phase** | **PPM Sulfur Added** |
| 4/5/2018 | 1 | Naptha | Blank | 0 | 30 | 0 | 3 | 180mins | 50 | 10 | 0.00 |
| 3/20/2018 | 2 | Naptha | DDSA | 20 | 30 | 6 | 2 | 180mins | 50 | 10 | 0.00 |
| 3/22/2018 | 3 | Naptha | Alkyl Dithiothiadiazole | 10 | 30 | 3 | 2 | 180mins | 50 | 10 | 2.50 |
| 3/22/2018 | 4 | Naptha | Alkyl Dithiothiadiazole | 20 | 30 | 6 | 1 | 180mins | 50 | 10 | 5.00 |
| 4/6/2018 | 5 | Naptha | 80% DDSA<br>20% Alkyl Dithiothiadiazole | 10 | 30 | 2.4<br>.6 | 1 | 180mins | 50 | 10 | 0.50 |
| 4/5/2018 | 6 | Naptha | 80% DDSA<br>20% Alkyl Dithiothiadiazole | 20 | 30 | 4.8<br>1.2 | 1 | 180mins | 50 | 10 | 1.00 |
| 4/5/2018 | 7 | Naptha | 80% DDSA<br>20% Alkyl Dithiothiadiazole | 40 | 30 | 9.6<br>2.4 | 1 | 180mins | 50 | 10 | 2.00 |
| 4/5/2018 | 8 | Naptha | 80% DDSA<br>20% Alkyl Dithiothiadiazole | 80 | 30 | 19.2<br>4.8 | 1 | 180mins | 50 | 10 | 4.00 |

SILVER CORROSION INHIBITOR COMPOSITION AND METHOD OF USE

CROSS REFERENCE TO RELATED APPLICATIONS

This application is a national phase of International Patent Application No. PCT/US2018/046068 filed Aug. 9, 2018, the entirety of which is incorporated herein by reference.

FIELD OF INVENTION

The disclosed technology generally described hereinafter provides for a synergistic fuel additive composition, and more specifically, a synergistic fuel additive composition and method of reducing sulfur content, where the fuel additive decreases sulfur content while still meeting silver corrosion specifications.

BACKGROUND OF THE INVENTION

Generally, spark ignition fuels, commonly referred to as gasoline, have silver corrosion and sulfur specifications that must be met by refiners and importers prior to introducing gasoline into commerce. In some cases, refinery processing units fail to remove trace contaminants that prevent the gasoline from meeting the silver corrosion specification such as the one contained in the ASTM D4814, Standard Specification for Automotive Spark-Ignition Engine Fuel.

In many of these cases, refiners and gasoline importers turn to corrosion inhibitor additives to help meet the specification. The industry workhorse silver corrosion inhibitor, alkyl dithiothiadiazole, contains sulfur and typically introduces several ppm of sulfur into treated gasoline. As such, the treated gasoline meets corrosion specifications, but may not meet sulfur regulations such as those found in the U.S. EPA's Tier 3 Gasoline Sulfur Regulations. Failure to meet the sulfur regulations can result in costly penalties in the form of sulfur credit purchases from other refiners and/or importers, where such sulfur credit purchases can potentially cost millions of dollars.

SUMMARY OF THE INVENTION

The disclosed technology generally described hereinafter provides for synergistic fuel additive composition and method of reducing sulfur content in a fuel composition, where the fuel additive decreases sulfur content while still meeting silver corrosion specifications.

In one aspect of the disclosed technology, a synergistic fuel additive composition is provided. The synergistic fuel additive composition, the composition comprising: a sulfur additive; and a non-sulfur containing additive, wherein the ratio of the sulfur additive to the non-sulfur additive is about 1:1 to about 1:100.

In some embodiments, the sulfur additive comprises the formula

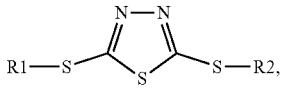

wherein R1 and R2 are independently selected from a 4-20 carbon alkyl thiol forming disulfide bond, a hydrogen, and a 4-20 carbon hydrocarbyl group.

In some embodiments, the non-sulfur containing additive comprises a plurality of fatty acids from C8 to C22 monocarboxylic acids and/or C8 to C22 dicarboxylic acid or anhydrides. In some embodiments, the composition does not cause silver corrosion. In some embodiments, the fuel additive composition reduces sulfur content in a fuel composition by at least 50%.

In another aspect of the disclosed technology, a method of reducing sulfur content in a fuel composition is provided. The method comprising: adding a fuel additive to a fuel composition, the fuel composition requiring a silver corrosion inhibitor, wherein the fuel additive provides less than 5 ppm of sulfur addition.

In some embodiments, the fuel additive comprises a sulfur additive and a non-sulfur containing additive. In some embodiments, the ratio of the sulfur additive to the non-sulfur additive is from about 1:1 to about 1:100.

In some embodiments, the sulfur additive comprises the formula

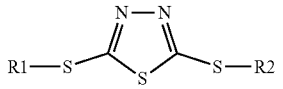

wherein R1 and R2 are independently selected from a 4-20 carbon alkyl thiol forming disulfide bond, a hydrogen, and a 4-20 carbon hydrocarbyl group.

In some embodiments, the non-sulfur containing additive comprises a plurality of fatty acids from C8 to C22 monocarboxylic acids. In some embodiments, the non-sulfur containing additive comprises a plurality of fatty acids from C8 to C22 dicarboxylic acid or anhydrides. In some embodiments, the fuel additive provides less than 2 ppm of sulfur addition. In some embodiments, the fuel additive provides less than 0.50 ppm of sulfur addition.

In yet another aspect of the present technology, a method of reducing sulfur content in a fuel composition is provided. The method comprising: adding a fuel additive to a fuel composition, the fuel composition requiring a silver corrosion inhibitor, the fuel additive comprising: a sulfur additive and a non-sulfur containing additive, wherein the ratio of the sulfur additive to the non-sulfur containing additive is from about 1:1 to about 1:100; wherein the fuel additive provides less than 5 ppm of sulfur addition to the fuel composition; and wherein the fuel composition does not cause silver corrosion.

In some embodiments, the sulfur additive comprises the formula

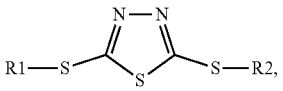

wherein R1 and R2 are independently selected from a C4 to C20 carbon alkyl thiol forming disulfide bond, a hydrogen, and a C4 to C20 carbon hydrocarbyl group.

In some embodiments, the non-sulfur containing additive comprises a plurality of fatty acids from C8 to C22 monocarboxylic acids and/or C8 to C22 dicarboxylic acid or anhydrides. In some embodiments, the fatty acids comprise alkenyl or alkyl succinic acids. In some embodiments, the alkenyl or alkyl succinic acids comprise dodecenyl succinic acid or dodecyl succinic acid.

In some embodiments, the fatty acids comprise alkenyl or alkyl succinic anhydrides. In some embodiments, the alkenyl or alkyl succinic anhydride comprise dodecenyl succinic anhydride or dodecyl succinic anhydride. In some embodiments, the fatty acids comprise monocarboxylic acids. In some embodiments, the monocarboxylic acids comprise oleic acid, linoleic acid, or linolenic acid.

In some embodiments, the fuel additive provides less than 2 ppm of sulfur addition. In some embodiments, the fuel additive provides less than 0.50 ppm of sulfur addition. In some embodiments, the fuel additive provides less than 0.1 ppm of sulfur addition.

BRIEF DESCRIPTION OF THE DRAWINGS

These and other features of the disclosed technology, and the advantages, are illustrated specifically in embodiments now to be described, by way of example, with reference to the accompanying diagrammatic drawings, in which:

FIG. 1 is a table providing results of an illustrative embodiment of the disclosed technology.

DETAILED DESCRIPTION OF EXEMPLARY EMBODIMENTS

The disclosed technology generally described hereinafter provides for a fuel additive composition. The fuel additive composition provides for a synergistic effect of reducing the amount of sulfur addition to a fuel composition, yet still meets the silver corrosion specification requirements required by the U.S. EPA and potentially other regulatory entities. By using the fuel additive composition of the present invention, the amount of sulfur addition is significantly lowered, while still exhibiting improved performance in accordance with ASTM D7671 and/or ASTM D7667 test methods.

The synergistic fuel additive composition comprises a sulfur additive and a non-sulfur containing additive. In some embodiments, the ratio of the sulfur additive to the non-sulfur additive is from about 1:1 to about 1:100.

In some embodiments, the sulfur additive comprises the formula (I)

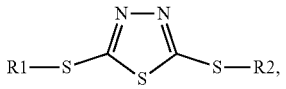

wherein R1 and R2 are independently selected from a 4-20 carbon alkyl thiol forming disulfide bond, a hydrogen, and a 4-20 carbon hydrocarbyl group.

In some embodiments, the non-sulfur containing additive comprises a plurality of fatty acids from C8 to C22 monocarboxylic acids and/or C8 to C22 dicarboxylic acid or anhydrides. In some embodiments, the non-sulfur containing additive comprises a plurality of fatty acids or anhydrides having between C8 to C22 with either one or two carboxylic acid groups, and in other embodiments, having between C8 to C18 succinic acids or anhydrides.

In some embodiments, the plurality of fatty acids comprise alkenyl or alkyl succinic acids or anhydrides, such as, but are not limited to, dodecenyl succinic acid or anhydride (DDSA), dodecyl succinic acid or anhydride, hexadecenyl succinic acid or anhydride, hexadecyl succinic acid or anhydride. In other embodiments, the plurality of fatty acids comprise monocarboxylic acids, such as, but are not limited to, oleic acid, linoleic acid, and/or linolenic acid.

In some embodiments, the non-sulfur containing additive is dodecenyl succinic acid or anhydride (DDSA), or a Tall oil Fatty Acid (TOFA). In some embodiments, the non-sulfur containing additive comprises a plurality of fatty acids having between C8 to C22 with either one or two carboxylic acid groups. In some embodiments, the synergistic fuel additive composition comprises alkyl dithiothiadiazole and dodecenyl succinic acid (DDSA) or TOFA.

The synergistic fuel additive composition of the disclosed technology does not cause silver corrosion. In some embodiments, the synergistic fuel additive composition reduces sulfur content in a fuel composition by at least 50%, and in other embodiments, by at least 80%.

The fuel additive composition of the disclosed technology allows for the synergistic effect of decreasing the sulfur content of a fuel composition by at least 80% to produce a passing rate of about 1 (based on ASTM D7667 or ASTM D7671 test methods for silver corrosiveness), while being able to simultaneously decrease the treatment dose. By reducing the treatment dose, the amount of sulfur provided in the finished blend will be reduced.

In some embodiments, the fuel additive composition is added to a fuel composition in a treatment dosage of about 10 ppmv. By decreasing the treatment dose of the fuel additive composition, refiners will be able to meet the required sulfur specifications without incurring regulatory penalties for going beyond the sulfur limit.

In other embodiments, the fuel additive composition is added to a fuel composition in a treatment dosage of between about 10 and about 80 ppmv. It should be understood by a person of ordinary skill that other dosage amounts may be necessary to pass the required corrosion specification.

In some embodiments, the treatment dosage of the fuel additive composition when added to a fuel can be reduced by at least 50%.

In yet another embodiment of the disclosed technology, a method of reducing sulfur content in a fuel composition is provided. The method comprises adding a fuel additive to a fuel composition comprising a silver corrosion inhibitor, wherein the fuel additive provides less than 5 ppm. It should be understood by one skilled in the art that sulfur addition is defined as a byproduct of typical silver corrosion inhibition products that tend to have sulfur species in them. As the dosage of the inhibitor increases to protect from corrosion, the total amount of sulfur in the fuel is increased. Due to tightening government regulations, which continue to decrease the amount sulfur that is acceptable in a fuel product, a successful fuel additive should provide low sulfur addition.

In other embodiments, the fuel additive provides less than 2 ppm of sulfur addition, in other embodiments, less than 1 ppm of sulfur addition, in other embodiments, less than 0.50 ppm of sulfur addition, and in other embodiments, less than 0.1 ppm of sulfur addition.

In some embodiments, the fuel composition comprises gasoline, or gasoline blends, as defined by ASTM D4814. In some embodiments, the fuel additive of the present method comprises a sulfur additive and a non-sulfur containing additive. In some embodiments, the sulfur additive, as previous described, comprises the formula (I) below,

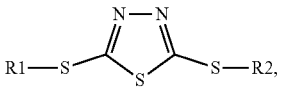

wherein R1 and R2 are independently selected from a 4-20 carbon alkyl thiol forming disulfide bond, a hydrogen, and a 4-20 carbon hydrocarbyl group.

In some embodiments, the non-sulfur containing additive comprises a plurality of fatty acids having between C8 to C22 with either one or two carboxylic acid groups. In some embodiments, the non-sulfur containing additive comprises a plurality of fatty acids having between C8 to C18 with either one or two carboxylic acid groups.

In some embodiments, the fatty acids comprise an alkyl succinic acid or a monocarboxylic acid. In some embodiments, the fatty acid is dodecenyl succinic acid (DDSA) and/or dodecyl succinic acid. In some embodiments, the fatty acid comprises monocarboxylic acids such as, but not limited to, oleic acid, linoleic acid, and/or linolenic acid.

In a specific embodiment, a method of reducing sulfur content in a fuel composition is provided. The method comprising adding a fuel additive to a fuel composition, the fuel composition requiring a silver corrosion inhibitor, the fuel additive comprising: a sulfur additive and a non-sulfur containing additive, wherein the ratio of the sulfur additive to the non-sulfur containing additive is from about 1:1 to about 1:100; wherein the fuel additive provides less than 5 ppm of sulfur addition to the fuel composition; and wherein the fuel composition does not cause silver corrosion.

EXAMPLES

The present invention will be further described in the following examples, which should be viewed as being illustrative and should not be construed to narrow the scope of the disclosed technology or limit the scope to any particular embodiments.

FIG. 1 provides the Silver Strip Test Results in a hydrocarbon containing 10 ppmw $H_2S$ liquid.

As shown in FIG. 1, the standard industry product alkyl thiothiadiazole (Experiment #3) when used alone exhibits a failing silver strip corrosion rating of 2, while adding 2.50 ppm of sulfur. Additionally, when DDSA is used alone (Experiment #2), while it does not add any additional sulfur, it still does not provide a passing silver strip rating, (i.e. it does not provide a silver strip rating of 1).

However, as shown in comparative examples (Experiment #5-8, the fuel additive composition of the present technology provides a synergistic effect. The synergistic fuel additive comprising a blend of 80% DDSA and 20% alkyl thiothiadiazole exhibited a passing silver strip corrosion rating of 1, while simultaneously providing an added sulfur content of between 0.50 ppm and 4.0 ppm.

While embodiments of the disclosed technology have been described, it should be understood that the present disclosure is not so limited and modifications may be made without departing from the disclosed technology. The scope of the disclosed technology is defined by the appended claims, and all devices, processes, and methods that come within the meaning of the claims, either literally or by equivalence, are intended to be embraced therein.

The invention claimed is:

1. A synergistic fuel additive composition, the composition comprising a blend of a sulfur additive and a non-sulfur containing additive, wherein the ratio of the sulfur additive to the non-sulfur additive is about 1:1 to about 1:100, wherein the sulfur additive comprises the formula

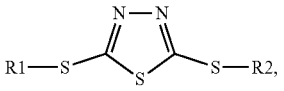

wherein (i) R1 is selected from a 4-20 carbon alkyl thiol forming disulfide bond, a hydrogen, and a 4-20 carbon hydrocarbyl group, and R2 is selected from 4-20 carbon alkyl thiol forming disulfide bond and a 4-20 carbon hydrocarbyl group; or (ii) R1 is selected from 4-20 carbon alkyl thiol forming disulfide bond and a 4-20 carbon hydrocarbyl group, and R2 is selected from a 4-20 carbon alkyl thiol forming disulfide bond, a hydrogen, and a 4-20 carbon hydrocarbyl group, and wherein the non-sulfur containing additive comprises a plurality of fatty acids from C8 to C22 monocarboxylic acids and/or C8 to C22 dicarboxylic acid or anhydrides.

2. The fuel additive composition as recited in claim 1, wherein the fuel additive composition reduces sulfur content in a fuel composition by at least 50%.

3. A method of reducing sulfur content in a fuel composition, the method comprising:

adding a fuel additive to a fuel composition, the fuel composition requiring a silver corrosion inhibitor, the fuel additive comprising a blend of a sulfur additive and a non-sulfur containing additive, wherein the ratio of the sulfur additive to the non-sulfur containing additive is from about 1:1 to about 1:100;

wherein the fuel additive provides less than 5 ppm of sulfur addition to the fuel composition; and wherein the fuel composition does not cause silver corrosion.

4. The method as recited in claim 3, wherein the sulfur additive comprises the formula

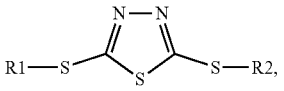

wherein R1 and R2 are independently selected from a C4 to C20 carbon alkyl thiol forming disulfide bond, a hydrogen, and a C4 to C20 carbon hydrocarbyl group.

5. The method as recited in claim 3, wherein the non-sulfur containing additive comprises a plurality of fatty acids from C8 to C22 monocarboxylic acids, and/or C8 to C22 dicarboxylic acids or anhydrides.

6. The method as recited in claim 5, wherein the fatty acids comprise alkenyl or alkyl succinic acids.

7. The method as recited in claim 6, wherein the alkenyl or alkyl succinic acids comprise dodecenyl succinic acid or dodecyl succinic acid.

8. The method as recited in claim 5, wherein the fatty acids comprise alkenyl or alkyl succinic anhydrides.

9. The method as recited in claim 8, wherein the alkenyl or alkyl succinic anhydride comprise dodecenyl succinic anhydride or dodecyl succinic anhydride.

10. The method as recited in claim 5, wherein the fatty acids comprise monocarboxylic acids.

11. The method as recited in claim 10, wherein the monocarboxylic acids comprise oleic acid, linoleic acid, or linolenic acid.

12. The method as recited in claim 3, wherein the fuel additive provides less than 2 ppm of sulfur addition.

13. The method as recited in claim 3, wherein the fuel additive provides less than 0.50 ppm of sulfur addition.

14. The method as recited in claim 3, wherein the fuel additive provides less than 0.1 ppm of sulfur addition.

* * * * *